US005219280A

United States Patent [19]

Yashiro

[11] Patent Number: 5,219,280

[45] Date of Patent: Jun. 15, 1993

[54] FUEL INJECTION PUMP PLUNGER

[75] Inventor: Hidekatsu Yashiro, Higashi-Matsuyama, Japan

[73] Assignee: Zexel Corporation, Japan

[21] Appl. No.: 936,070

[22] Filed: Aug. 26, 1992

Related U.S. Application Data

[63] Continuation of Ser. No. 649,073, Feb. 1, 1991, abandoned.

[30] Foreign Application Priority Data

Feb. 9, 1990 [JP] Japan ..... 2-11570[U]

[51] Int. Cl.[5] ..... F04B 07/04

[52] U.S. Cl. ..... 417/499; 123/500

[58] Field of Search ..... 417/499; 123/449, 496, 123/500, 501

[56] References Cited

U.S. PATENT DOCUMENTS

| | | | |
|---|---|---|---|
| 2,696,786 | 12/1954 | Fleck et al. | 417/499 |
| 4,013,055 | 3/1977 | Sommer | 417/499 |
| 4,625,700 | 12/1986 | Elsbett et al. | 123/500 |
| 4,784,098 | 11/1988 | Artman . | |
| 4,824,341 | 4/1989 | Augustin | 417/499 |

FOREIGN PATENT DOCUMENTS

| | | |
|---|---|---|
| 311727 | 11/1973 | Fed. Rep. of Germany . |
| 3332470 | 3/1984 | Fed. Rep. of Germany . |

*Primary Examiner*—Richard A. Bertsch
*Assistant Examiner*—Michael I. Kocharov
*Attorney, Agent, or Firm*—Ostrolenk, Faber, Gerb & Soffen

[57] ABSTRACT

A fuel injection pump plunger which enables the timing of the fuel injection to be controlled in accordance with the engine load, and can be used to prevent the emission of exhaust smoke and to achieve quieter engine operation, and under full-load conditions enables the engine to regain speed rapidly.

4 Claims, 2 Drawing Sheets

FUEL INJECTION PUMP PLUNGER

This is a continuation of application Ser. No. 07/649,073, filed on Feb. 1, 1991, abandoned.

BACKGROUND OF THE INVENTION

1. Field of the Invention

The present invention relates to the plunger of a fuel injection pump of a diesel engine, and more particularly to a fuel injection pump plunger which enables the timing of the fuel injection to be controlled and facilitates engine performance recovery when the engine is running under full load.

2. Description of the Prior Art

In a conventional fuel injection pump of a diesel engine, fuel is sucked in and expelled under pressure by the reciprocating action of a plunger in a fuel chamber formed in the plunger barrel.

Adjustment and control of the timing at which the injection of the fuel is started and stopped are done by providing upper and lower leads in the head of the plunger and adjusting the relative positional relationship between these leads and the fuel intake and exhaust port formed in the barrel.

More specifically, the head of the plunger is provided with a sloping lower lead and a longitudinal groove which connects the lower lead to the plunger chamber. When the accelerator is pressed, the timing of the end of the fuel injection operation is controlled by rotating the plunger by an amount corresponding to the depression of the accelerator, changing the relative positional relationship between the lower lead and the fuel port. As such, this can be used to control the fuel injection amount.

An upper lead is formed sloping down from the upper face of the plunger facing the plunger chamber at a position of vertical opposition to the lower lead. When the accelerator is pressed, the timing of the start of the fuel injection operation is controlled by rotating the plunger by an amount corresponding to the depression of the accelerator, changing the relative positional relationship between the upper lead and the fuel port. As such, this can be used to control the fuel injection timing.

In addition, engine noise can be reduced by adjusting the upper lead to retard the timing of the fuel injection by an amount corresponding to the engine load. In rapid idling regions (meaning regions in which exceeding the rated engine speed causes the governor mechanism to reduce the fuel injection amount), however, this gives rise to a smokey exhaust caused by fuel which has not undergone complete combustion being emitted through the still-open exhaust port.

JP-B-55-28863 is an example of a disclosure of a fuel injection pump arrangement which uses this type of upper lead arrangement to control the timing of the fuel injection, reduce engine noise and prevent the emission of exhaust smoke. However, another problem that arises when an upper lead arrangement is the sole means used to reduce noise and prevent a smokey exhaust is that under full-load conditions it increases the time it takes a diesel engine to come back up to speed. That is, although under full-load conditions it is preferable to produce a rapid recovery in the engine speed by increasing the fuel injection rate and advancing the timing of the fuel injection, with the above upper lead arrangement the fuel injection timing remains retarded even under full-load conditions, so the engine therefore takes longer to regain its speed.

An object of the present invention is therefore to provide a fuel injection pump plunger which enables the timing of the fuel injection to be controlled in accordance with the engine load and without using a conventional timer arrangement based on a lead provided in the plunger head. The fuel injection pump plunger according to the present invention prevents the production of exhaust smoke at high idling speeds, provides quieter engine operation under partial loads and during full-load operation enables the engine to regain speed more rapidly.

The above object is attained with a fuel injection pump plunger according to the present invention which moves reciprocally within the plunger chamber to suck in fuel through a fuel port in the barrel and expel the fuel from a fuel outlet, comprising forming in the head of the plunger a sloping lower lead, a longitudinal groove which connects the lower lead to the plunger chamber, and an upper lead formed sloping down from the upper face of the plunger facing the plunger chamber at a position of vertical opposition to the lower lead, and an orifice portion in the form of a flat or the like which extends parallel with the axis of the plunger and connects the end of the upper lead to the plunger chamber and enables the injection timing to be advanced.

In the fuel injection pump plunger thus configured, the upper and lower leads are used to effect a fuel injection timing (starting and stopping) control which corresponds with the engine load, and, if required, can be used to reduce engine noise and prevent the production of exhaust smoke.

Moreover, the orifice constituted by a flat or the like provided at the end of the upper lead makes it possible to suppress retardation of the fuel injection timing when the engine is running under a full-load condition.

Thus, in contrast to an arrangement in which only an upper lead is provided and there is no orifice portion so the timing of the closing of the fuel port (the start of the fuel injection) is therefore determined solely by the position of the upper face of the plunger, giving rise to large variations in the effective fuel delivery stroke, the provision of the orifice portion after the end of the upper lead in accordance with the present invention makes it possible to suppress extreme changes in the effective stroke, and as a result it is possible to suppress degradation of engine recovery when the engine is running under full-load conditions. In addition, adjusting the plunger prestroke is facilitated by enabling the orifice portion to be used for the adjustment.

Further features of the invention, its nature and various advantages will be more apparent from the accompanying drawings and following detailed description of the invention.

DETAILED DESCRIPTION OF THE INVENTION

Figure 1:
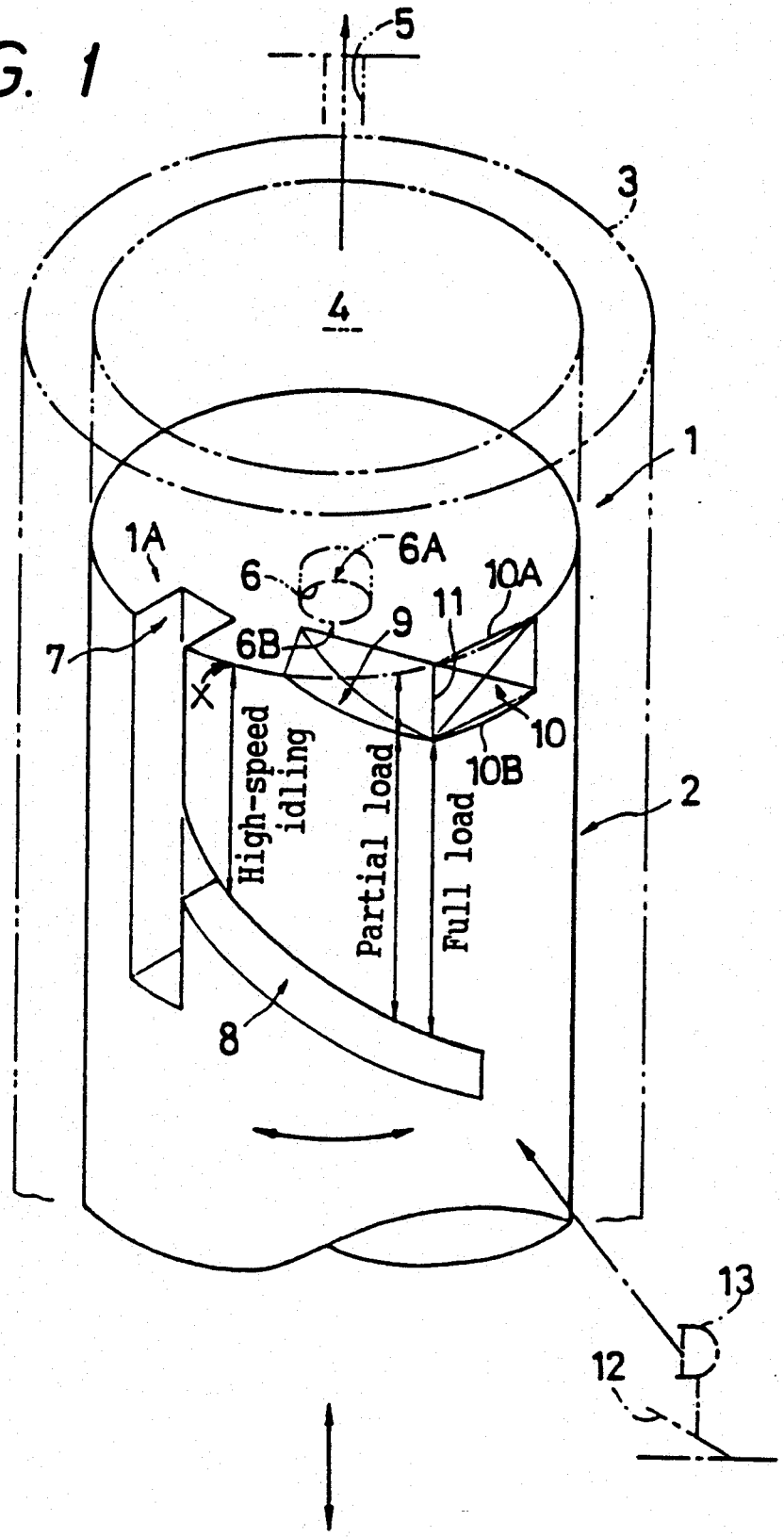
FIG. 1 is a perspective view of the head of a fuel injection pump plunger according to a first embodiment of the present invention.
Figure 2:
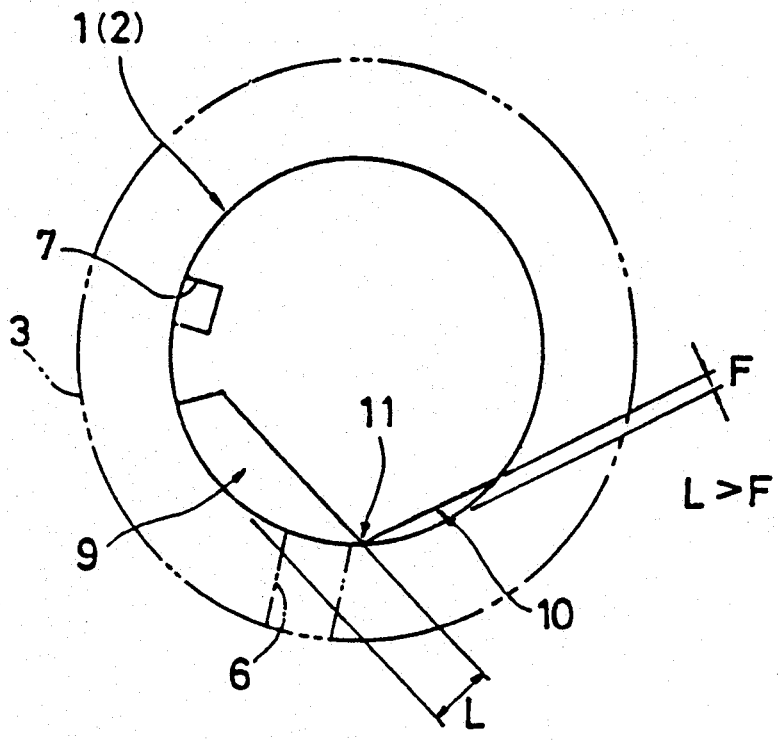
FIG. 2 is a plan view of the head shown in FIG. 1.

An embodiment of the invention will now be described with reference to the drawings. In FIGS. 1 and 2, a head 2 of a plunger 1 can rotate and reciprocate within a plunger barrel 3. Fuel from a high-pressure plunger chamber (fuel pressure chamber) 4 is passed through a fuel outlet 5 and emitted from a fuel injection nozzle (not shown). A fuel port 6 is provided in the barrel 3.

The plunger head 2 is provided with a longitudinal groove 7 which connects the plunger chamber to a sloping lower lead 8 also formed in the head 2. This lower lead 8 is for controlling the fuel injection end timing. Specifically, the amount of fuel that is injected is controlled by the rotation in either direction of the plunger 1 which, by raising the plunger 1 and thus changing the period of communication between the lower lead 8 and the fuel port 6, adjusts the effective fuel injection stroke.

An upper lead 9 corresponding to the lower lead 8 is provided sloping downwards from the upper face IA of the plunger 1. The start timing of the fuel injection is adjusted by rotating the plunger 1 to change the position of contact between the upper lead 9 and the fuel port 6. Prestroke adjustment of the plunger 1 is used to determine the advancement or retardation of the fuel injection timing.

An orifice portion 10 constituted by a flat, for example, is formed on a portion of the peripheral surface of the plunger 1, starting at the end of the upper lead 9 and extending in a direction parallel to the axis of the plunger 1. The upper part of the orifice flat 10 opens into the plunger chamber 4.

Ideally the ridge line 11 where the flat 10 and upper lead 9 intersect should be located on the outer peripheral surface of the plunger 1, but from practical fabrication considerations it may be located within the radius of the head 2, with a slight overlap between the flat 10 and the upper lead 9.

As shown in FIG. 2, the relationship between the width F of the flat 10 and the width L of the upper lead 9 is $L>F$. The widths F and L are therefore set at values which ensure the required orifice effect of the flat 10 is attained during the delivery of the fuel accompanying the elevation of the plunger 1.

The descent of the plunger 1 thus configured causes fuel to be sucked through the fuel port 6 into the plunger chamber 4. Compression of the fuel for the injection process starts when as a result of the elevation of the plunger 1 the upper face IA and upper lead 9 reach the upper edge 6A, closing the fuel port 6, and the release pressure of the fuel injection nozzle valve is exceeded.

The prestroke of the plunger 1 is defined as the distance between the bottom dead center of the plunger and the point at which the upper face IA and upper lead 9 reach the top edge 6A of the fuel port 6.

The continuing rise of the plunger 1 brings the lower edge 6B of the fuel port 6 to the position of the lower lead 8, thereby connecting the fuel port 6 to the longitudinal groove 7 and stopping the fuel injection. The timing of this termination of the fuel injection (and the fuel injection amount) is controlled by the operation of a fuel injection amount control rack 13 linked to an accelerator 12 to change the rotational position of the plunger 1 relative to the barrel 3, i.e. the relative positional relationship between the fuel port 6 and the lower lead 8. This also changes the position of the upper lead 9 relative to the fuel port 6, so that when pressing the accelerator 12 is used to rotate the plunger 1 to the left (with reference to FIG. 1), the result is that the plunger prestroke is lengthened, retarding the fuel injection timing. This means that, as indicated by FIG. 3, increasing the engine load retards the fuel injection timing.

When the plunger 1 is rotated further, bringing the fuel port 6 level with the flat 10 (a full-load state), when the upper edge 6A of the fuel port 6 is below the upper edge 10A of the flat 10, the fuel injection is in effect started at a point after edge 10A is above upper edge 6A of the fuel port 6, by the orifice effect of the flat 10, enabling the injection timing to be advanced. Normal fuel injection does not start until the fuel port 6 is closed by the lower edge 10B of the flat 10.

Figure 3:
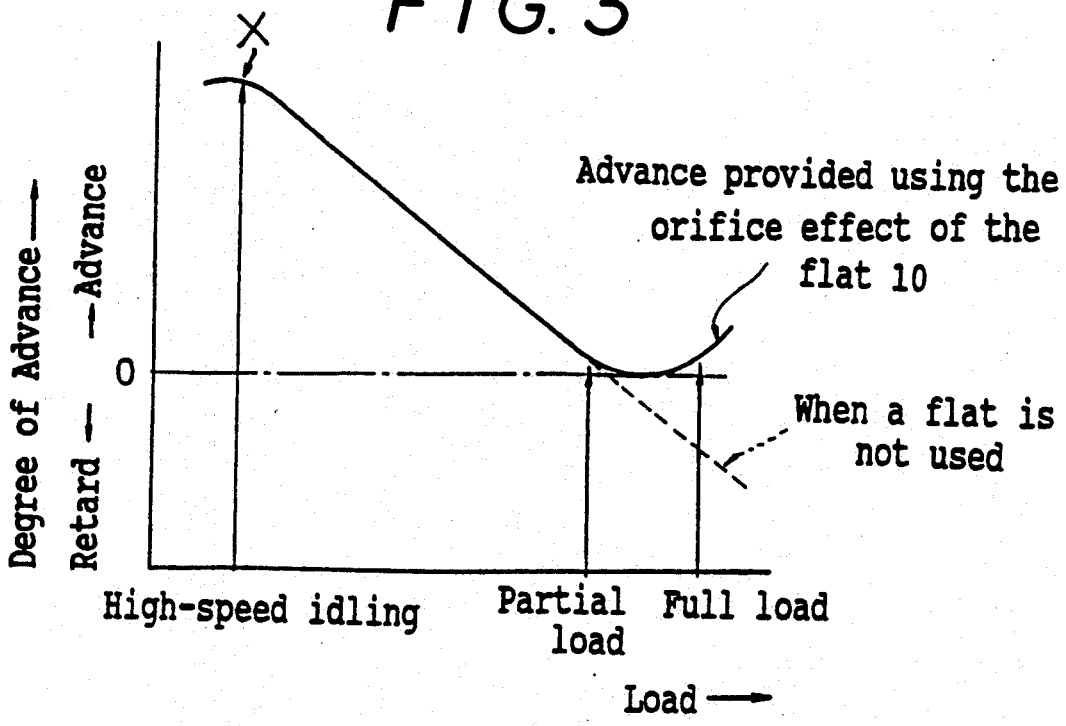
FIG. 3 is a graph showing the relationship between engine load and the degree of advancement of the fuel injection timing.

In FIG. 3, the ridge line 11 is set as the a transition point X (zero advance point), and when this is exceeded by full-load engine operation, the timing is advanced by the orifice effect of the flat 10, as indicated by the solid line. The broken line in FIG. 3 indicates the retardation state in the case of a conventional plunger not having a flat 10; this shows that retardation is increased with the increase in the engine load. Thus, as the timing has to be advanced after the engine is released from full-load operation, it takes longer for the engine to regain speed. In contrast, with the plunger 1 of the present invention the timing can be advanced even during full-load operation, so engine recovery is rapid.

The present invention can be applied to a wide range of engine requirements by appropriately varying the form, position, slope and relative positional arrangement of the upper lead 9, lower lead 8, flat 10 and the other parts.

What is claimed is:

1. A fuel injection pump plunger which moves reciprocally within a plunger chamber of a plunger barrel to suck in fuel through a fuel port in the barrel and expel fuel from a fuel outlet, the plunger comprising:

a plunger head provided with a sloping lower lead formed sloping downward on a peripheral surface of the plunger head;

a longitudinal groove connecting the lower lead to the plunger chamber;

an upper lead formed sloping downward from an upper face of the plunger head facing the plunger chamber at a position of vertical opposition to the lower lead;

an orifice constituted by a cut portion which extends parallel with an axis of the plunger between an end of the upper lead and the plunger chamber;

means for rotating the plunger to vary the relative positional relationship between the upper lead and the fuel port to advance or retard the fuel injection timing and to vary the relative positional relationship between the lower lead and the fuel port to control the fuel injection amount; and wherein within the range of rotation of the plunger the orifice cut portion corresponds to a full-load operating region of an engine and the relationship between a width F of the orifice cut portion and a width L of the upper lead is $L>F$, whereby the timing of the fuel injection can be advanced through an orifice effect produced by the orifice cut portion during the delivery of fuel accompanying the elevation of the plunger.

2. The fuel injection pump plunger according to claim 1 further comprising within the range of rotation of the plunger, a ridge line portion disposed at an intersection between the upper lead and the orifice cut portion, wherein said ridge line portion corresponds to a transition point of fuel injection.

3. The fuel injection pump plunger according to claim 1 wherein when said plunger rises upward in the barrel the fuel port is closed by a lower edge of the orifice cut portion and fuel injection commences.

4. The fuel injection pump plunger according to claim 1 wherein the orifice portion is a flat.

* * * * *